United States Patent [19]

Mohr

[11] Patent Number: 4,801,903

[45] Date of Patent: Jan. 31, 1989

[54] WAVEGUIDE LOOP DIRECTIONAL COUPLER

[75] Inventor: Hans J. Mohr, Mountain View, Calif.

[73] Assignee: Varian Associates, Inc., Palo Alto, Calif.

[21] Appl. No.: 904,993

[22] Filed: Sep. 8, 1986

[51] Int. Cl.[4] ..... H01P 5/18

[52] U.S. Cl. ..... 333/113; 333/26

[58] Field of Search ..... 333/109, 113, 111, 248, 333/26

[56] References Cited

U.S. PATENT DOCUMENTS

| | | | |
|---|---|---|---|
| 2,975,380 | 3/1961 | Scharfman | 333/248 X |
| 3,214,684 | 10/1965 | Everitt | 333/230 X |
| 3,609,675 | 9/1971 | Abele | 333/109 X |
| 3,725,824 | 4/1973 | McDonald | 333/260 X |
| 4,051,447 | 9/1977 | Heckman, Jr. | 333/260 X |
| 4,206,428 | 6/1980 | Kaegebein | 333/230 X |
| 4,551,694 | 11/1985 | Biehl et al. | 333/24 C |
| 4,689,627 | 8/1987 | Lee et al. | 343/776 X |

FOREIGN PATENT DOCUMENTS

| | | | |
|---|---|---|---|
| 0604987 | 7/1948 | United Kingdom | 333/113 |

*Primary Examiner*—Eugene R. LaRoche
*Assistant Examiner*—Seung Ham
*Attorney, Agent, or Firm*—Stanley Z. Cole; John C. Yakes; Peter J. Sgarbossa

[57] ABSTRACT

A loop directional RF coupler between a waveguide and coaxial line maintains a high degree of directivity while providing substantially improved coupling values. A conductive loop assembly terminating the coaxial line is accepted into an aperture means defining an aperture in one wall of the waveguide section of the coupler. The aperture is greater in diameter than the largest transverse dimension of the loop, or of the loop assembly. A capacitive or inductive conductive obstacle is affixed to an interior wall of the waveguide section adjacent the aperture. A second conductive obstacle is positioned downstream of the first obstacle to compensate any mismatch.

27 Claims, 2 Drawing Sheets

WAVEGUIDE LOOP DIRECTIONAL COUPLER

FIELD OF INVENTION

This invention relates to coupling devices for transferring radio frequency (RF) power between different transmission lines, and more particularly to directional couplers for coupling RF power between primary and secondary transmission lines in only one direction with improved efficiency and directivity.

PRIOR ART

Directional couplers for transferring RF power (including microwave power) between different transmission lines are widely used and readily available in the art. Their application includes power level sampling and monitoring, particularly sampling and discriminating betweeen incident and reflected power within a given transmission line; power dividers or attenuators; local oscillator injection networks; and microwave hybrid circuits. Directional couplers can take many different physical forms, depending on the characteristics which are desired to be emphasized. The characteristics of interest would include power handling capacity, frequency range, directivity, degree of coupling desired, compactness or weight constraints, and cost constraints.

Among the most efficient directional couplers are multi-hole couplers of broad wall and narrow wall design. In concept, these can bring together two separate transmission lines, for example two rectangular waveguides, so as to effectively define a common wall therebetween. This common wall zone is then made into a junction by providing same with a multiplicity of apertures, to enable coupling of RF power between the two waveguides. Of course, the length of such a junction is typically quite large compared to the width of the waveguides involved.

Such designs have superior power handling characteristics and superior power coupling coefficients or values; that is, a relatively large proportion of power from one line can be coupled into the other line. However, they have some considerable disadvantages, particularly large physical size and weight, and large insertion length, that is, they have a minimum length in the axial direction of the waveguide which is large compared to the waveguide width. Similar advantages and disadvantages also accrue to other related design approaches for such directional couplers, such as branch guide couplers and crossed-guide couplers.

Another class of directional couplers, that of the waveguide resistive loop couplers, is much more physically compact overall, generally lower in cost, and requires a substantially shorter insertion length for the same frequency than the foregoing prior art designs. Such loop couplers are commercially available for a wide range of frequencies from several sources, such as Microwave Development Laboratories, Inc., of Natick, Mass. They are especially useful in applications in which coupling is to be established between a primary transmission line, such as a waveguide, and a secondary transmission line, such as a coaxial line.

A review of the capabilities of such directional loop couplers reveals that this class of couplers also has certain limitations, a primary one being that of relatively modest power coupling values, as compared to the aforementioned designs. For example, in several bands between 2.6 and 5 Gigahertz, typical coupling values might be 35 to 70 decibels; and of the several bands between 4 to 8 Gigahertz, 30 to 70 decibels of coupling value may be typical. Good directivity, i.e., the sensitivity to a signal from the desired direction of detection is at least 20 decibels greater than that from the non-preferred direction, is easily provided in these designs. But if it is sought to achieve better, tighter power coupling between primary and secondary transmission lines, good directivity characteristics no longer can be maintained. One physical factor which has been found to be a probable limitation on such better power coupling is that the dimensions of the aperture through which the two waveguides communicate is normally quite limited. Yet such physical factors as the aperture cannot be disturbed without affecting directivity adversely.

SUMMARY OF THE INVENTION

Accordingly, it is an object of the invention to provide a loop directional coupler having improved coupling characteristics.

It is a further object of the invention to provide a loop directional coupler with improved coupling characteristics as above, but which also retains the advantages of small physical size, a small insertion length, and superior directivity.

It is still another object of the invention to provide an improved directional coupler in accordance with the above, and which has in addition a simple and rugged design, and one which is easily and inexpensively manufactured.

These and other objects of the invention are achieved by providing a looped directional coupler between a waveguide transmission line and a second transmission line which includes a length of waveguide member for insertion into such waveguide transmission line. This waveguide member defines an aperture means in one wall thereof, generally intermediate the ends of the member. A termination assembly is provided for the second transmission line for coupling RF power between the secondary line and the waveguide, with the aperture means accepting the termination assembly therewithin. This loop termination assembly has a maximum dimension transverse to the longitudinal axis of the secondary line. The aperture defined by the aperture means in the waveguide member wall also has a maximum dimension which is similar to or greater than the maximum dimension of the termination assembly. The termination assembly is orientatable within the aperture means in order to determine directivity of the coupling of the RF power. The rotational position of the termination assembly about the longitudinal axis of the secondary transmission line determines the degree of discrimination against power traveling either upstream or downstream within the waveguide. The interior of the waveguide member is furnished with at least one conductive obstacle to RF power moving within the waveguide. The cross section of this obstacle is small with respect to the cross section of the waveguide interior, and is positioned near the aperture.

In this manner a coupler construction is provided which features coupling values substantially better than with prior art loop couplers, while providing at least equal directivity, compactness and small insertion length features. The physical structures imposed by prior design constraints have been eliminated, yet the changes and additions needed to accomplish the invention do not impose significant complexities or manufacturing difficulties much beyond earlier designs. Indeed, the present invention involves at least one significant structural simplification, in particular at the aforesaid aperture means.

DESCRIPTION OF THE PREFERRED EMBODIMENTS

Figure 1A:
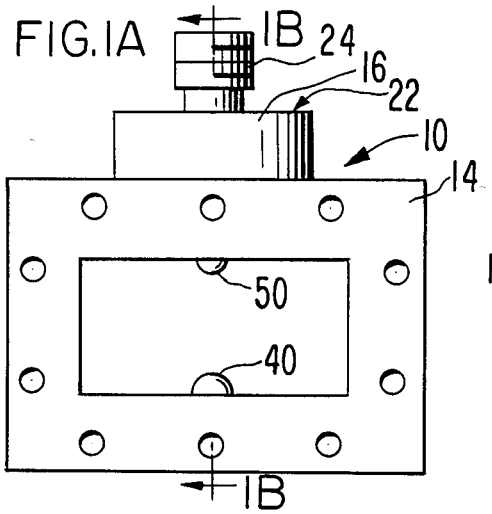
FIG. 1A is an end view of a waveguide loop directional coupler assembly in accordance with the invention, viewing into the interior of the waveguide member portion of such assembly from one end of that waveguide member.
Figure 1B:
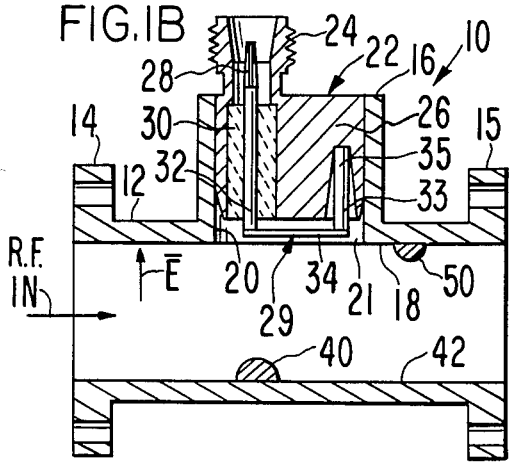
FIG. 1B is a sectional view of the assembly of FIG. 1A , taken along plane 1—1 of FIG. 1A, and parallel to the longitudinal axis of the waveguide member.

The directional coupler assembly 10 of FIGS. 1A and 1B includes a section of waveguide member 12 which is rectangular in cross-section, and which is typically of aluminum or brass. (The same numerals as used in FIGS. 1A and 1B, but in primed and double-primed form, will be used to identify elements in FIGS. 2A and 2B and FIGS. 3A and 3B, respectively, which are identical to their counterparts in FIGS. 1A and 1B.) Cross-sectional dimensions are in accordance with standard practice and with the typical width-to-height ratio near 2 to 1. Actual dimensions will, of course, vary in accordance with the desired frequency or band of operation, and are chosen so that the waveguide member, along with the waveguide primary transmission line into which it will be inserted, will operate in the dominant $TE_{10}$ mode. The particular embodiments illustrated have utilized standard WR-284 sized waveguide material, in accordance with their preferred operating band of 2.7 to 2.9 Gigahertz.

The ends of the waveguide member 12 are supplied with standard end flanges 14 and 15 to enable convenient insertion into a matching primary waveguide transmission line (not shown). Although waveguide member or section 12 has been shown as rectangular and is preferred to be in such form, waveguides having other cross-sectional shapes, such as circular section, may also be utilized. It will be noted that the length of section 12 in the axial direction need be only a modest multiple of the width of section 12, and certainly less than an order of magnitude greater (although, of course, section 12 can be made longer if required).

Waveguide section 12 is provided with an apertured boss portion 16 within its top-most wall 18 and generally midway of flange ends 14 and 15, to serve as an aperture defining means and to serve as a means accepting a connector to a secondary RF transmission line, for example, a typical coaxial line (not shown). Portion 16 extends upwardly from wall 18 and defines a central cylindrical bore 20, with an axis of symmetry intersecting orthogonally the central longitudinal axis of waveguide section 12, with the bore axis also being parallel to the E-field vector of the dominant mode in the rectangular waveguide. Cylindrical bore 20 thus defines a circular aperture 21 of the same diameter in top waveguide wall 18.

A termination assembly 22 is provided for insertion into cylindrical bore 20 of the apertured boss 16. This assembly 22 serves to provide a proper matching resistive or lossy termination for a secondary RF transmission line, here a standard coaxial line (not shown) to which it will be desired to couple power to or from the waveguide. The secondary transmission line is connected to assembly 22 via standard coupling 24, which in this example is a standard SMA coaxial coupling. The body 26 of the termination assembly is metal, for example, brass, and of a generally cylindrical shape, having dimensions matching cylindrical bore 20, in order to be readily insertable therewithin. The outer conductor of coaxial coupling 24 is electrically (and physically) coextensive with body 26 of assembly 22, and thus also with wall 18 of waveguide section 12. Inner conductor 28 of coupling 24, on the other hand, is electrically isolated from body 26 by insulator 30, and is coextensive with a proximal end 32 of a loop conductor 29 mounted within body 26.

Loop conductor 29 has it's proximal end 32 encased in insulator 30, extending parallel to the axis of bore 20, and terminating in a medial portion 34 extending parallel to the longitudinal axis of waveguide section 12 while being evenly spaced a small distance from the lower face of body 26. Finally, loop conductor 29 defines a distal end 33 extending transversely from medial portion 34 back into body 26, and which is encased in a resistance 35 and in electrical contact at its extreme end with body 26.

In this manner loop conductor 29, and hence, a secondary transmission line attached thereto, is terminated into assembly 22 with a properly matching resistance. In a preferred example, the coaxial line will be a 50 ohm line, and the resistance 35 will be of matching value. During assembly and adjustment of the device, the termination assembly 22 may be moved axially inwardly or outwardly of bore 20 in order to control the degree of coupling of RF power between primary and secondary transmission lines.

The directivity of coupling of power to the secondary transmission line from the waveguide (or vice-versa) is controlled by the rotational orientation of termination assembly 22 within the bore 20 with respect to the longitudinal axis of the bore (or with respect to the axis of the secondary transmission line). More particularly, for maximum directivity, assembly 22 is rotated within bore 20 until the plane of loop 29 is generally aligned with the longitudinal axis of the waveguide section 12, and so that the proximal end 32 of the loop and the off-axis coaxial coupling 24 are positioned closest to the end of waveguide section 12 through which the RF power desired to be coupled is incoming. Thus, if one assumes that RF power is initially incoming through section 12 in the direction indicated in FIG. 1*b* from the left, and that some of the power is reflected back in the opposite direction; and one desires to couple to the secondary transmission line only the incoming power while discriminating against any reflected component, then the rotational position of termination assembly 22 should be as indicated in FIG. 1B. As shown in FIG. 1B, the proximal end 32 of loop and the coaxial connector is positioned closest to the flange end, 14 of waveguide section 12.

On the other hand, if it is desired to couple the reflected power, rather than the incident power, the assembly 22 would then be rotated so that proximal end 32 of the loop and coaxial coupling 24 are positioned closest the opposite flange end 15 of waveguide section 12. Again, end 32 and coupling 24 would be closest to that end of the waveguide into which the RF component desired to be coupled would be incoming, in this case, the reflected component. In this way, the RF component which it is desired to be coupled can be preferentially discriminated typically to 20 DB or better. Thus, the device is useful, for example, in monitoring applications to determine comparative levels of incident and reflected power. Two such coupling assemblies with respective termination assemblies 22 oriented oppositely can be used simultaneously in the same waveguide in order to monitor both reflected and incident power components.

It will be noted that bore 20 is of the same diameter throughout, terminating in wall aperture 21; and that this diameter is at least as large as the overall diameter of the termination assembly 22. Further, the diameter of aperture 21 is larger than medial portion 34, or larger than the maximum dimension of loop conductor 29 in a direction transverse to the axis of coupler 24, or the axis of the secondary line. Accordingly, the full elongated extent of flat medial conductor portion 34 of the loop conductor is available to the fields within the waveguide section 12, enabling improved, tighter coupling. No longer does the aperture need to be controlled in size in order to trade off coupling tightness for the sake of directivity. Rather, the maximum extent of loop conductor 29 can be made available for interaction with the primary waveguide.

However, such a large diameter aperture and improved coupling without loss of directivity is only obtainable in combination with yet another feature of the invention, that of a strategically-positioned first conductive obstacle 40 to RF power moving within waveguide section 12. Obstacle 40 is affixed to an interior wall 42 of waveguide section 12 adjacent and facing aperture 21, and presents a cross-section to the power travelling inside the section which is small compared to the cross-section of the waveguide itself. In this case, obstacle 40 is in the form of a hemisphere and is a capacitive obstacle, with the E-field of the dominant mode in the waveguide extending orthogonally to wall 42. However, the obstacle need not be capacitive, but can be an equivalent inductance instead; also, it may take other forms, for example, a conductive rod.

Figure 2A:
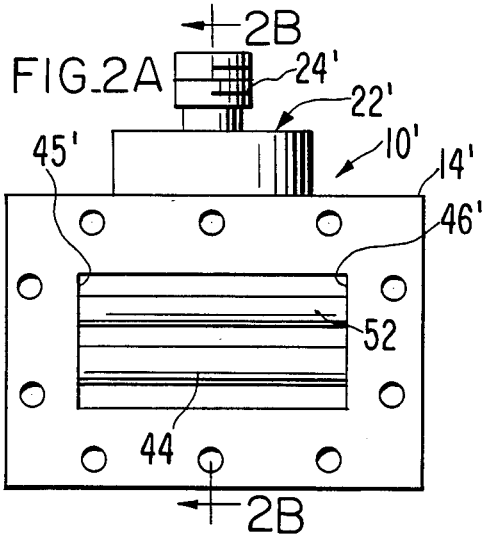
FIG. 2A is an end view similar to that of FIG. 1A of another similar embodiment.
Figure 2B:
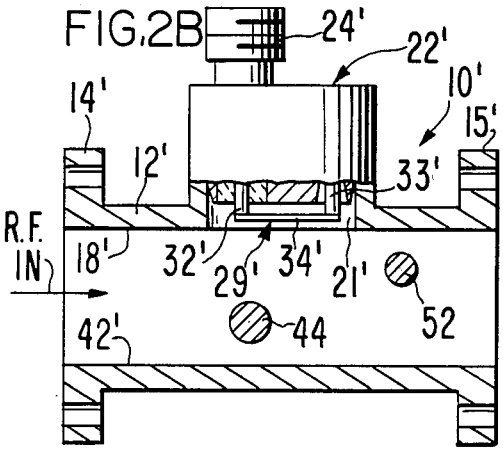
FIG. 2B is a sectional view of the assembly of FIG. 2B, taken along plane 2—2 of FIG. 2B.
Figure 3A:
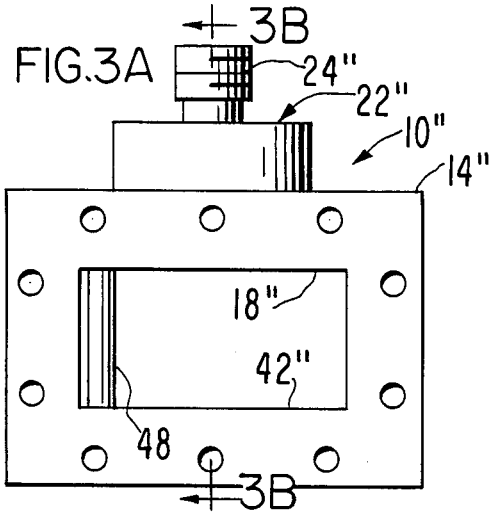
FIG. 3A is an end view similar to those of FIGS. 1A and 2A of a related embodiment.
Figure 3B:
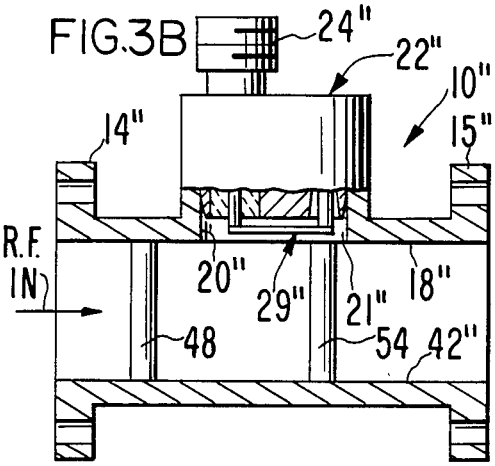
FIG. 3B is a sectional view of the assembly of FIG. 3B, taken along plane 3—3 of FIG. 3A.

In the embodiment of FIGS. 2A and 2B, the first conductive obstacle takes the form of a laterally oriented rod 44 extending between the vertical walls 45' and 46' of waveguide section 12', as well as parallel to the plane of aperture 21'. Rod 44, too, is a capacitive obstacle. In the embodiment of FIGS. 3A and 3B, the first conductive obstacle takes the form of an upright rod 48 extending between horizontal walls 42" and 18", as well as parallel to the axis of bore 20" and coaxial connector 24". Rod 48 is an inductive obstacle which is the electrical equivalent of obstacles 40 and 44. In order to obtain such equivalence, rod 48 is positioned a distance which is the equivalent of one-quarter of the wave length of the operating frequency upstream from the position which the equivalent capacitive obstacle would otherwise occupy, for example, obstacle 40. Since obstacle 40 is located in alignment with the axis of coaxial coupler 24 (or proximal leg 32 of conductive loop 29), then rod 48 is located a distance equivalent of one-quarter of the wave length from this position, between aperture 21" and flange end 14", which is the end receiving the incoming power, the component desired to be coupled in the example illustrated in FIG. 3.

In the FIG. 2 embodiment, the capacitive first obstacle 44 (as with obstacle 40) is aligned with the axis of coaxial coupler 24' and proximal portion 32' of loop 29'. This obstacle (as also obstacle 40) is also in spaced facing relationship to flat medial 30 portion 34' of loop 29'. In the case of obstacle 40 of FIG. 1, it may be seen that it is also oriented in alignment with a central plane of waveguide section 12, passing through walls 18 and 42, as well as with the plane of loop conductor 29 when the loop is oriented for maximum directivity.

Returning to the FIG. 2 embodiment, the capacitive first obstacle 44, while also positioned below and spaced from coaxial coupling 24', extends parallel to a cross-sectional plane of waveguide section 12' and orthogonally to the plane of conductive loop 29' when the loop is oriented for maximum directivity. It has been found that spacing the rod closer to wall 42' than to wall 18' appears to result in improved performance; but the exact placement of any of the obstacles 40, 44 and 48 is not easily susceptible to exact analysis, and is better done empirically for particular applications.

In the FIGS. 3A and 3B embodiment, the conductive first obstacle 48 is positioned adjacent but somewhat upstream of the aperture 21" as above described, so that the component of power desired to be coupled from the waveguide encounters the obstacle before arriving at the aperture. It has been found for the illustrated application that best performance is obtained with the rod obstacle 48 laterally displaced to one side of the plane defining conductive loop 29", but still parallel to such plane when the loop is oriented for maximum directivity, as may be seen in FIG. 3A.

In all of the embodiments, the first obstacles 40, 44 and 48 surprisingly function as "directivity enhancers", since they may be thought of as restoring the directivity qualities which would otherwise be lost by the above-described improvements involving maximizing the size of aperture 21 in relation to termination assembly 22 and loop 29. However, these first obstacles along with the comparatively large diameter aperture 21 as mentioned above, may cause undesirable mismatch effects along with their positive benefits.

But in a further aspect of the invention, it has been found that any such mismatch effects may be compensated by the judicious placement within waveguide section 12 of a second conductive RF obstacle 50 (FIG. 1), 52 (FIG. 2), 54 (FIG. 3) affixed to one or more interior walls of section 12. The second obstacle generally is of a form matching its companion first obstacle, and is placed downstream of its companion obstacle. Their separation distance may approximate one-quarter to one-half wave length, but as a practical matter, must be determined empirically for particular applications. So also must the transverse location with respect to the longitudinal axis, and the exact size and cross-section, although in many applications the second obstacle will be somewhat smaller than the first. In any case, the second matching obstacle 50, 52, 54 is always downstream of the first obstacle, that is, the power component sought to be detected always encounters the first obstacle before the second. In the cases of the FIGS. 1 and 2 embodiments, the second obstacle 50 and 52 is adjacent but just downstream of aperture 21, and both, of course, are capacitive obstacles, as are their companion obstacles. In the FIG. 3 embodiment, in which both obstacles are inductive, second obstacle 54 is also outside of aperture 21'', but to one side thereof and downstream of the axes of coupler 24'' and bore 20''. The second obstacle 54 is also, of course, downstream of first obstacle 48 by a distance comparable to the corresponding spacing between the other obstacle pairs.

It may be noted that the obstacles of the foregoing embodiments are illustrative examples only. Although the capacitive and inductive obstacles have been used separately in the above examples, combinations thereof could easily be implemented. Many other possible obstacle configurations are also possible and desireable depending on particular waveguide, secondary transmission line, and frequency applications. The above examples were obstacle configurations which were found especially effective for one particular application and frequency band, namely, 2.7 to 2.9 Gigahertz.

Figure 4:
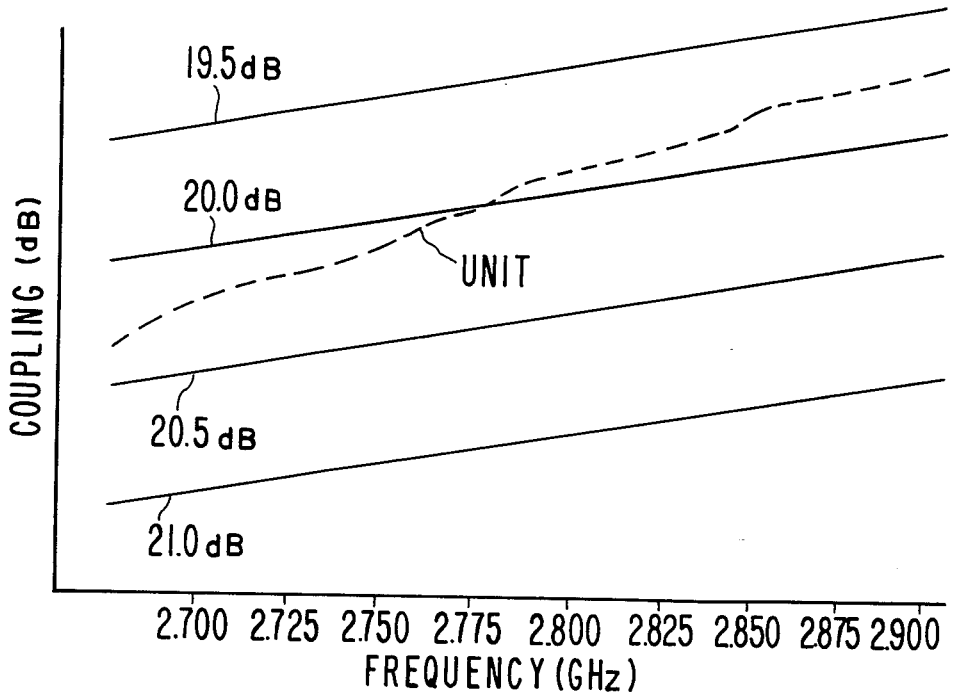
FIG. 4 is a plot of the coupling value of the coupler assembly of FIG. 2 over its operating bandwidth.
Figure 5:
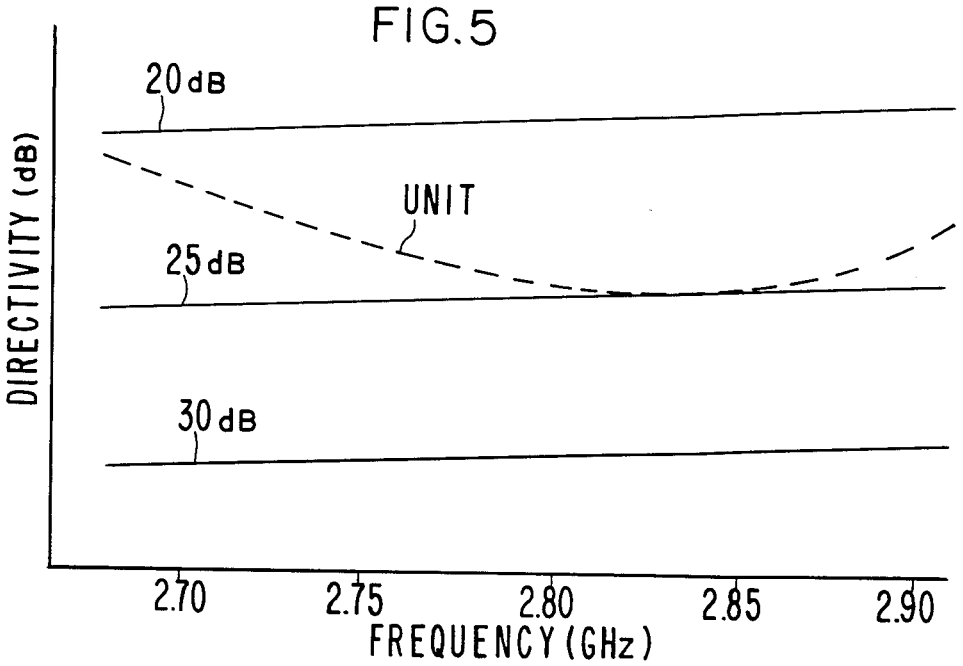
FIG. 5 is a plot of the directivity of the coupler assembly of FIG. 2 over its operating bandwidth.

The graphs of FIGS. 4 and 5 illustrate the typical and superior level of performance which can be expected from the inventive directional coupler assembly, in this case, the embodiment of FIGS. 2A and 2B. FIG. 4 illustrates the coupling values obtained in decibels over the operating frequency band of 2.7 to 2.9 Gigahertz. It will be seen that throughout the band, coupling values within plus or minus 0.5 decibel of the 20 decibel level are maintained, a considerable advance over coupling performance previously thought possible with such directional couplers. Directivity is at the same time easily maintained within 20 to 25 decibels over the entire band, as shown in FIG. 5. Despite the use of the obstacles within the waveguide section, input VSWR over the band continues to remain very acceptable.

What is claimed is:

1. A loop directional coupler between a waveguide transmission line and a secondary transmission line comprising:

a waveguide member for insertion into said waveguide transmission line, said waveguide member having an aperture-defining means in one wall generally intermediate the ends of said waveguide member;

a loop termination assembly for said second transmission line for coupling radio frequency power between said secondary transmission line and said waveguide transmission line, said aperture-defining means accepting said termination assembly therewithin;

said termination assembly including a loop conductor having a maximum dimension transverse to the longitudinal axis of said secondary transmission line, the maximum dimension of said aperture in said waveguide member wall being similar to or greater than said maximum dimension of said loop conductor;

the rotational orientation of said termination assembly within said aperture-defining means with respect to said longitudinal axis of said secondary transmission line determining the directivity and degree of discrimination against power traveling either upstream or downstream within said waveguide;

the interior of said waveguide member being provided with first and second electrically conductive obstacles to RF power moving within said waveguide, the cross-sections of said obstacles being small with respect to the cross-section of said waveguide, said first obstacle being selectively disposed proximate said aperture to enhance the directivity of said loop conductor, said second obstacle being selectively disposed in spaced apart relationship from said first obstacle in the downstream direction of travel of the power sought to be preferentially coupled so as to compensate for mismatch effects introduced by said first obstacle.

2. A loop directional coupler as in claim 1 in which said second conductive obstacle is similar to or smaller than said first obstacle.

3. A loop directional coupler as in claim 1 in which said first conductive obstacle is generally a hemisphere attached to an interior wall of said waveguide member.

4. A loop directional coupler as in claim 4 in which said hemisphere is positioned opposite said aperture and generally in alignment therewith.

5. A loop directional coupler as in claim 1 in which said first conductive obstacle is a metallic rod extending across said waveguide members.

6. A loop directional coupler as in claim 5 in which said rod extends across said waveguide member orthogonally to the waveguide longitudinal axis and to the electric field direction.

7. A loop directional coupler as in claim 5 in which said rod is generally in alignment with said aperture.

8. A loop directional coupler as in claim 5 in which said rod extends across said waveguide member orthogonally to said waveguide longitudinal axis and parallel to the electric field direction.

9. A loop directional coupler as in claim 5 in which said rod is positioned adjacent to and upstream of said aperture so that the power sought to be coupled from said waveguide member into said second transmission line encounters said rod prior to arriving at said aperture.

10. A loop directional coupler as in claim 1 in which the length of said waveguide member in the axial direction is less than an order of magnitude greater than the largest transverse width of said waveguide.

11. A loop directional coupler as in claim I in which said aperture-defining means defines a right cylindrical bore disposed orthogonally to the longitudinal axis of said waveguide member.

12. A loop directional coupler as in claim 11 in which the depth of said cylindrical bore is similar to the height of said termination assembly, said termination assembly being generally cylindrical and of a diameter similar to that of said cylindrical bore.

13. A directional coupler assembly to couple radio frequency power between a rectangular waveguide transmission line operating in the dominant $TE_{10}$ mode and a coaxial transmission line operating in the TEM mode, said coupler comprising:

a section of rectangular waveguide of a cross-section similar to that of said waveguide line, for insertion into said waveguide line;

said waveguide section defining aperture means in one of the walls thereof, said one wall being one of those having the greatest width in a direction transverse to the longitudinal axis of the waveguide, said aperture means being positioned intermediate the edges of said one wall, said aperture means defining a cylindrical bore terminating in an aperture in said one wall;

a termination assembly for said coaxial line, said assembly having a generally cylindrical metallic housing adapted to be inserted within said cylindrical bore, said assembly being provided at one end thereof with a coaxial coupler having a center conductor for receiving one end of said coaxial line, said coaxial coupler being located off axis of said termination assembly, said assembly including a conductive loop, said loop having a proximal end beginning with said center conductor of said coaxial coupler, said proximal end being insulated from said metallic housing, said loop having a distal end, said assembly further including a matching resistance into which the distal end of said loop is terminated;

said coupler being oriented to be generally in line with the waveguide axis and closest to one end of said waveguide section, whereby power incoming into said one end is preferentially discriminated;

the interior or said waveguide section being provided with first and second electrically conductive obstacles to the power traveling therewithin, said obstacles having cross-sections which are small with respect to the cross-section of said waveguide, said first obstacle being selectively disposed at an axial position within said waveguide proximate said aperture position to enhance the directivity of said conductive loop, said second obstacle being selectively disposed in spaced apart relationship from said first obstacle in the downstream direction of travel of the power sought to be preferentially coupled so as to compensate for mismatch effects introduced by said first obstacle.

14. A directional coupler assembly as in claim 13 in which said conductive loop includes a medial portion intermediate said distal and proximal ends, said medial portion extending generally parallel to the plane of said aperture, and in which said first obstacle is positioned at a location facing said medial portion in spaced relationship thereto.

15. A directional coupler assembly as in claim 14 in which said medial portion of said conductive loop is parallel to the longitudinal axis of said waveguide section.

16. A directional coupler assembly as in claim 13 in which said first conductive obstacle is a capacitive obstacle.

17. A directional coupler assembly as in claim 13 in which said first conductive obstacle is an inductive obstacle.

18. A directional coupler assembly as in either of claim 16 or 17 in which said second conductive obstacle is a capacitive obstacle.

19. A directional coupler assembly as in either claim 16 or 17 in which said second conductive obstacle is an inductive obstacle.

20. A directional coupler assembly as in claim 16 in which the axial position within said waveguide of said first conductive obstacle is substantially aligned with the longitudinal axis of said coaxial coupler.

21. A directional coupler assembly as in claim 17 in which said first conductive obstacle is a distances which is the equivalent of one-quarter of the wavelength of the operating frequency and upstream with respect to the direction of the power component sought to be coupled, as measured from the axially longitudinally position of said coaxial coupler.

22. A directional coupler as in claim 1 in which the direction of the E-field of the dominant mode in said waveguide is parallel to the longitudinal axis of said secondary transmission line.

23. A directional coupler assembly as in claim 13 in which said first conductive obstacle is oriented parallel to the plane defined by said conductive loop.

24. A directional coupler assembly as in claim 13 in which said first conductive obstacle is oriented orthogonally to the plane defined by said conductive loop.

25. A directional coupler assembly as in claim 23 in which said first conductive obstacle is displaced to one side of said plane defined by said conductive loop, and is in the form of a rod extending between facing walls of said waveguide section.

26. A directional coupler assembly as in claim 24 in which said first conductive obstacle is in the form of a rod extending between facing walls of said waveguide section and is spaced from the remaining two walls of said waveguide section as well as being spaced from said conductive loop.

27. A directional coupler assembly as in claim 13 in which said aperture terminating said cylindrical bore is of a diameter greater than said maximum dimension of said conductive loop.

* * * * *